US006340953B1

(12) United States Patent
Teraoka et al.

(10) Patent No.: US 6,340,953 B1
(45) Date of Patent: Jan. 22, 2002

(54) ANTENNA DEVICE

(75) Inventors: Toshihiro Teraoka, Osaka; Toshio Ishizaki, Hyougo; Koichi Ogawa, Osaka; Tomoya Maekawa, Hyougo, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/527,232

(22) Filed: Mar. 16, 2000

(30) Foreign Application Priority Data

Mar. 19, 1999 (JP) ..... 11-075163
May 14, 1999 (JP) ..... 11-133812

(51) Int. Cl.[7] ..... H01Q 13/02
(52) U.S. Cl. ..... 343/776; 343/778
(58) Field of Search ..... 343/776, 783, 343/786, 772, 785, 777, 778, 753, 779, 781

(56) References Cited

U.S. PATENT DOCUMENTS 3,680,145 A * 7/1972 Beguin ..... 343/786
4,283,728 A * 8/1981 Bartlett ..... 343/781
4,628,321 A * 12/1986 Martin ..... 342/379
4,667,205 A * 5/1987 Gehin ..... 343/783
4,783,663 A * 11/1988 Rammos et al. ..... 343/778
4,998,113 A * 3/1991 Raghavan et al. ..... 343/776

FOREIGN PATENT DOCUMENTS

JP 56-107604 8/1981

* cited by examiner

*Primary Examiner*—Don Wong
*Assistant Examiner*—Chuc D. Tran
(74) *Attorney, Agent, or Firm*—McDermott, Will & Emery

(57) ABSTRACT

An antenna device comprising a plurality of directional antennas which are aligned on the same axis in one direction and which are also arranged in a manner that the main radiation directions of the plurality of directional antennas deviate from each other in a direction orthogonal to the direction. Hence, a drop in directivity due to the array factor can be prevented and radiation characteristics in the plane orthogonal to the direction is expanded.

15 Claims, 14 Drawing Sheets

ANTENNA DEVICE

BACKGROUND OF THE INVENTION

1. Field of the Invention

The present invention relates to an antenna device, and more specifically, to an antenna device used for a base station in a radio communication system with a submillimeter wave band or a millimeter wave band.

2. Description of the Related Art

Installation of optical fibers is being tried in order to achieve effective and high-speed transmission of a large amount of data in the current information-oriented society; however, high installment cost results in boosting the ratio of the total communication fees of ordinary households to access line fees (fixed fees portion).

Under these circumstances, establishing a radio communication system with a millimeter wave band (local radio network WLL) is now drawing attentions. This system makes it unnecessary to install lines up to users' houses and further provides a local area with services unique to the area at a low cost.

The important questions in establishing a radio communication system are how many terminal users each base station can accommodate and how fast the system can transmit large amounts of information accurately. As one solution of the questions, developing an antenna device is an urgent necessity.

As a base station antenna in the radio communication system with the millimeter wave band, using an antenna device with a horn antenna has been considered. The antenna device must be provided with wide radiation characteristics in a horizontal plane in order to cover a large service area.

FIG. 19 show s a prior art antenna device employing a horn antenna. The horn antenna 102 has the geometry of a pyramid in which the width A1 of an antenna opening 102*a* is larger than the width of the opening portion 101*a* of a waveguide 101.

However, the horn antenna often employed in a radio communication with a millimeter wave band is generally used as a high-gain antenna with a narrowed beam, so that the half-power beamwidth is generally narrow.

SUMMARY OF THE INVENTION

In view of the aforementioned problem, the main object of the present t invention is to secure wide radiation characteristics In a horizontal plane, in spite of the antenna device having a simple structure.

In order to achieve the object, the antenna device of the present invention comprises a plurality of directional antennas which are aligned on the same axis in one direction and which are also arranged in a manner that the main radiation directions of the plurality of directional antennas deviate from each other in a direction orthogonal to the direction. In this structure the radio waves from the directional antennas are radiated at least with the point coinciding with the same axis in the one direction as its center, so that the occurrence of a drop in directivity due to the array factor is prevented. Since the directivity in the antenna device is the combination of the directivities of all the directional antennas, the main radiation directions of the directional antennas can be deviated from each other in the one direction to expand the radiation characteristics in the plane orthogonal to the one direction.

The above-mentioned one direction is preferably a vertical direction, which could expand the radiation characteristics in the horizontal plane.

The antenna device preferably comprises a distribution circuit for supplying the plurality of directional antennas with electric powers.

In this case, various directivities can be obtained according to the following variations.

The distribution circuit supplies the plurality of directional antennas with electric powers of the same amplitude and the same phase.

The distribution circuit supplies the plurality of directional antennas with electric powers of the same amplitude and different phases.

The distribution circuit supplies the plurality of directional antennas with electric powers of the same phase and different amplitudes.

The distribution circuit supplies the plurality of directional antennas with electric powers of different amplitudes and different phases.

It is preferred that the antenna device further comprises a power supply part waveguide, and that the plurality of directional antennas are horn antennas connected to the power supply part waveguide. In this case, the half-power beamwidth can be further increased by making at least one of the plurality of directional antennas have an antenna opening shorter in width than the opening portion of the power supply part waveguide.

It is preferred that the antenna device further comprises a fixing plate which is arranged in a direction orthogonal to the one direction, wherein the plurality of directional antennas are provided with respective placing surfaces which are arranged parallel to the direction orthogonal to the one direction and which are in contact with the front and back sides of the fixing plate so as to fix the antenna device thereonto. In this case, the angles of the directional antennas made of horn antennas can be freely set by providing an installment angle setting unit for freely adjusting the main radiation directions of the plurality of directional antennas fixed on the fixing plate.

In an antenna device comprising a horn antenna connected to a power supply part waveguide, the half-power beamwidth can be increased by making the antenna opening of the horn antenna shorter in width than the opening portion of the power supply part waveguide.

In this case, the side surfaces of the horn antenna are tapered from the opening portion of the power supply part waveguide to the antenna opening. This makes the antenna opening of the horn antenna shorter in width than the opening portion of the power supply part waveguide, without causing a large drop in gain or increasing the internal volume of the antenna.

BRIEF DESCRIPTION OF THE DRAWINGS

The other objects of the invention will be clarified by the following description and specified in the attached claims. Executing the present invention will remind those skilled in the art of various advantages not mentioned in the present specification.

DETAILED DESCRIPTION OF THE INVENTION

Preferred embodiments of the present invention will be described as follows with reference to the drawings.

(First Preferred Embodiment)

Figure 1:
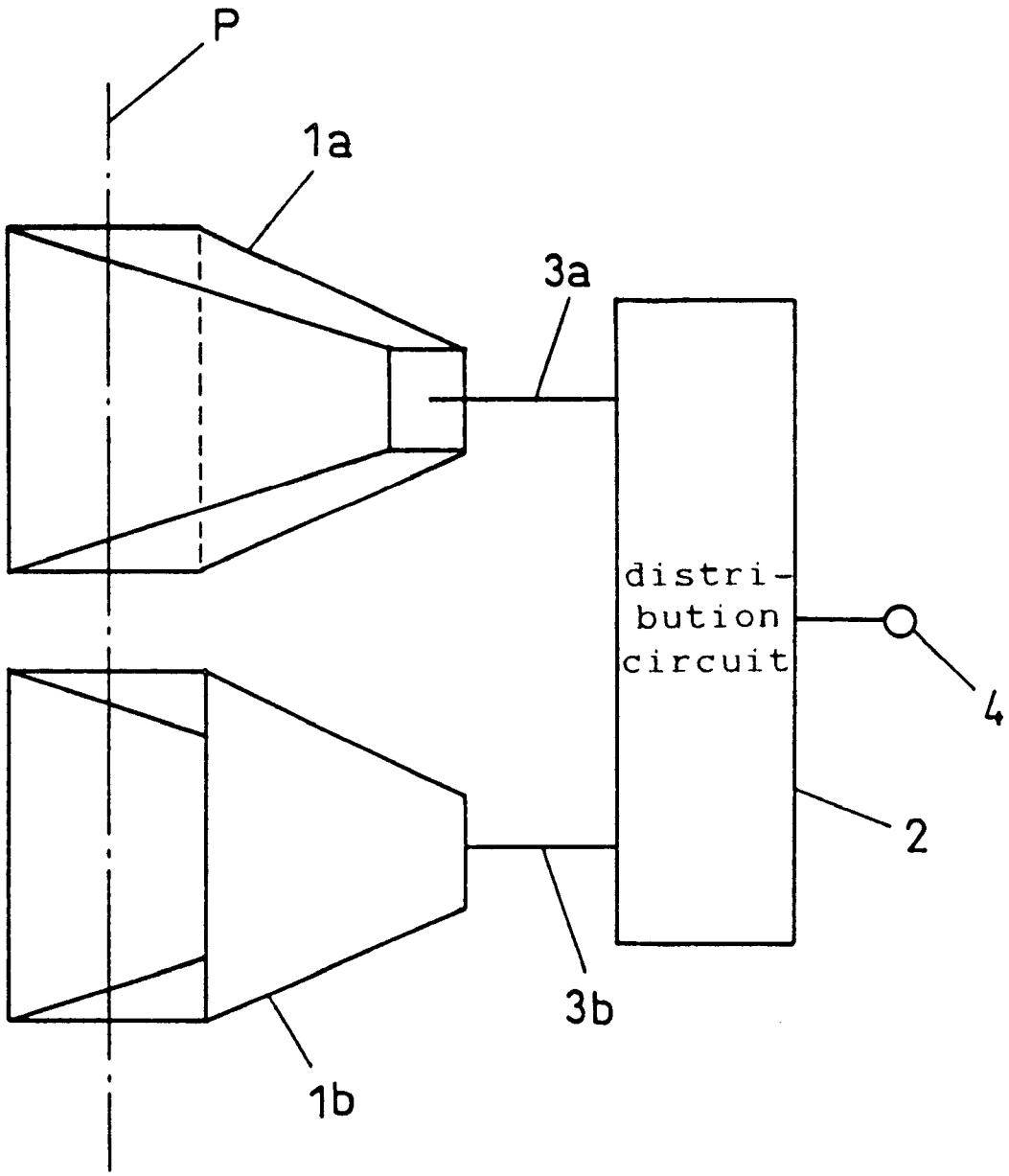
FIG. 1 is a side view showing the structure of an antenna device in accordance with a first preferred embodiment of the present invention.
Figure 2:
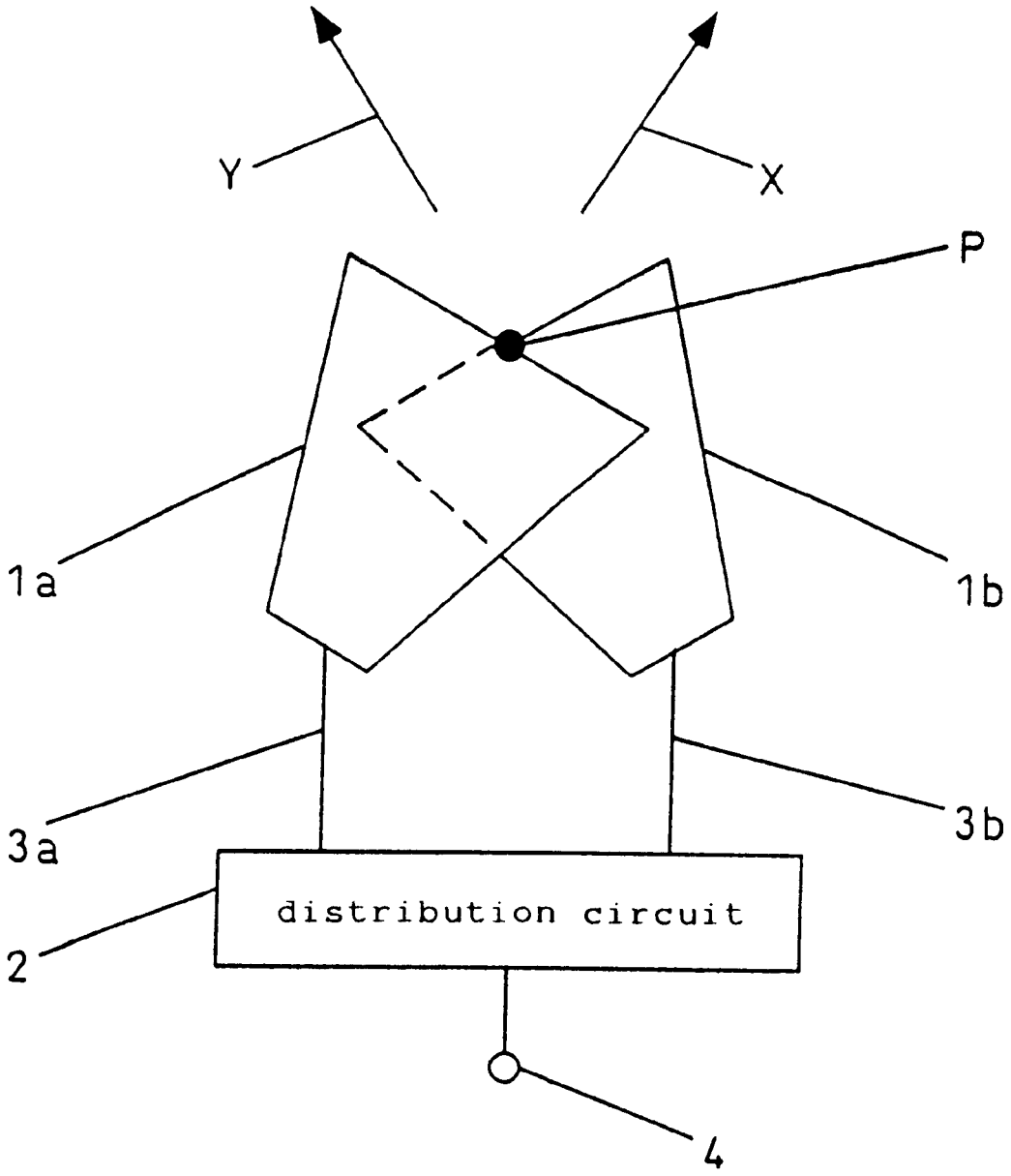
FIG. 2 is a plan view showing the structure of the antenna device in accordance with the first preferred embodiment.

As shown in FIGS. 1 and 2 an antenna device of the present embodiment comprises a first horn antenna 1*a* and a second horn antenna 1*b* each having a directivity in the horizontal direction, and a distribution circuit 2 which supplies an electric power to each of the antennas 1*a* and 1*b*.

In the present embodiment, the vertical direction is selected as a reference direction for the antenna device, and the horizontal direction is selected as the direction orthogonal to the reference direction; however, it goes without saying that any other direction could be selected as the reference direction.

The horn antennas 1*a* and 1*b* have their respective radiation centers aligned on the same axis P in the vertical direction, and are also arranged vertically in a manner that their respective main radiation directions X and Y deviate from each other in the horizontal direction, that is, the directions X and Y cross each other at the same axis P.

Although the radiation centers of the horn antennas 1*a* and 1*b* are illustrated on the antenna openings as shown in FIGS. 1 and 2, there are cases where the centers are inside the openings, so that in reality the horn antennas 1*a* and 1*b* are superimposed each other after their radiation centers are found through analysis or experiments.

The horn antennas 1*a* and 1*b* are connected, via power supply paths 3*a* and 3*b*, respectively, to the distribution circuit 2 which has an input/output terminal 4 connected to a radio (not shown). Through the input/output terminal 4, the electric power is entered into the distribution circuit 2 which distributes it to the hone antennas 1*a* and 1*b* via the power supply paths 3*a* and 3*b*, respectively.

The horn antennas 1*a* and 1*b* are thus arranged in the present embodiment because of the following reason. In the prior art structure, a plurality of horn antennas are too large in size to be arranged on the same horizontal plane, making it impossible to align their radiation centers on the same axis P. This forces one of these horn antennas to be arranged out of the axis P, which inevitably causes a drop in directivity due to the array factor.

In contrast, in the present embodiment, the horn antennas 1*a* and 1*b* are deviated from each other in the vertical direction while being aligned on the same axis P. Furthermore, the setting angle of each of the antennas 1*a* and 1*b* in the horizontal direction is determined so that the main radiation directions X and Y can turn laterally.

In this structure of the present embodiment, the radio waves in the horizontal plane coming from the horn antennas 1*a* and 1*b* are radiated with the point coinciding with the same axis P in the vertical direction as the radiation center, which effectively holds down dropping directivity due to the array factor. In addition, the directivities of the horn antennas 1*a* and 1*b* whose main radiation directions X and Y deviate from each other in the horizontal direction are composed. This expands the radiation of the entire antenna device in the horizontal plane.

When it is necessary to keep the radiation characteristics in the horizontal plane within a range of 120 degrees in the antenna device of the present embodiment, it can be done as follows. The horn antennas 1*a* and 1*b* having a half-power beamwidth of 60 degrees in the horizontal direction are prepared. These antennas 1*a* and 1*b* are aligned on the same axis P in the vertical direction in such a manner that their radiation centers are arranged on the same axis P. Furthermore, the setting angle of these antennas 1*a* and 1*b* in the horizontal direction are determined so as to deviate their radiation directions X and Y from each other by 60 degrees in the horizontal direction.

With the horn antennas 1*a* and 1*b* arranged as described above, the distribution circuit 2 will be structured as follows. A one-to-one Wilkinson power distribution circuit may be used as the distribution circuit 2, which supplies the horn antennas 1*a* and 1*b* with electric powers of the same amplitude and phase. The power supply paths 3*a* and 3*b* are made of coaxial cables of the same length. Thus the horn antennas 1*a* and 1*b* are supplied with powers of the same amplitude and phase via a waveguide coaxial converter (not shown).

Figure 3:
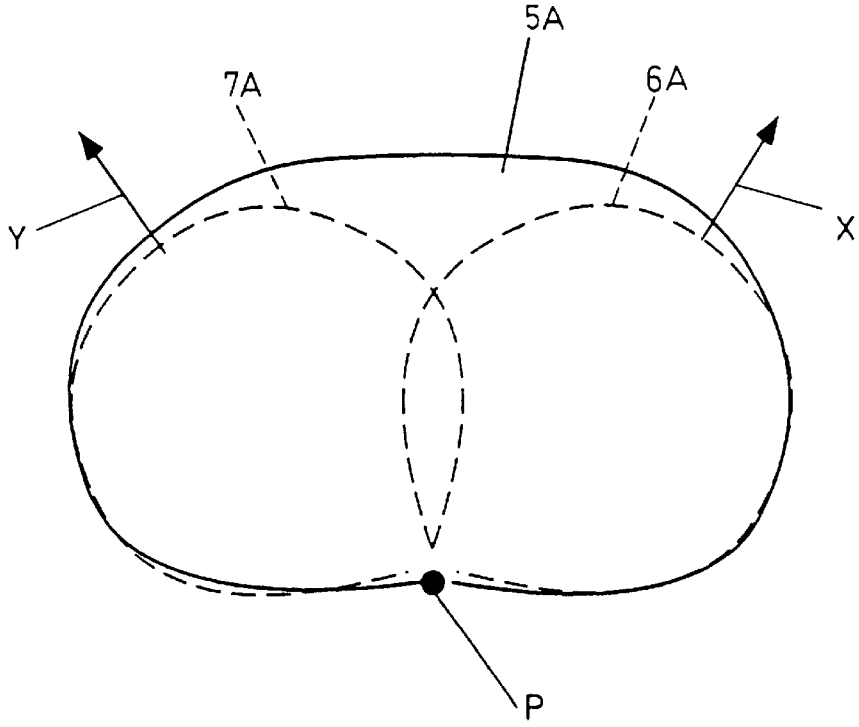
FIG. 3 shows the horizontal directivity of the antenna device in accordance with the first preferred embodiment.

The antenna device with the above-mentioned structure forms a composed directivity 5A in the horizontal direction as shown in FIG. 3. The composed directivity 5A is formed by composing the respective horizontal directivities 6A and 7A of the horn antennas 1*a* and 1*b* whose main radiation directions X and Y deviate from each other in the horizontal direction. The composed directivity 5A offers radiation characteristics which can cover a 120-degree range in the horizontal plane. The symbol P in FIG. 3 indicates a single axis, which coincides with the radiation centers of the overlapped horn antennas la and 1*b*.

In this case, supplying the horn antennas 1*a* and 1*b* with powers of the same phase achieves strong radiation characteristics in the horizontal direction. Alternatively, the horn antennas 1*a* and 1*b* can be supplied with powers which only differ in phase by making the power supply paths 3*a* and 3*b* differ in length. When the horn antennas 1*a* and 1*b* are supplied with powers of the same amplitude and different phases, radiation characteristics become wider in the vertical direction than in the horizontal direction.

It is another alternation to use as the distribution circuit 2 a one-to-n (n≠1) Wilkinson power distribution circuit which supplies the horn antennas 1*a* and 1*b* with electric powers of the same phase and different amplitudes, in place of the one-to-one Wilkinson power distribution circuit. Using this distribution circuit 2 and making the power supply paths 3*a* and 3*b* equal in length makes it possible to supply the horn antennas 1*a* and 1*b* with powers of different amplitudes, thereby obtaining a composed directivity 5B in the horizontal direction as shown in FIG. 4.

Figure 4:
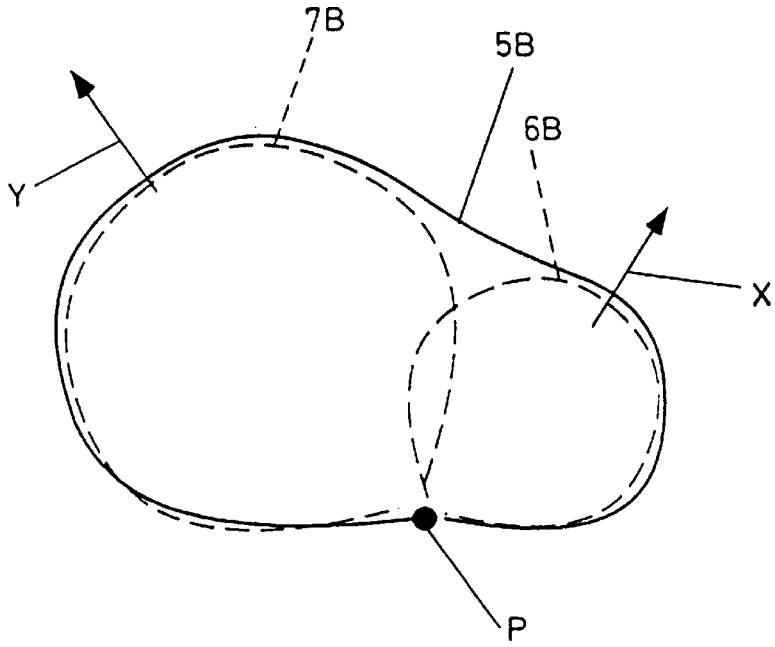
FIG. 4 shows the horizontal directivity of a modified antenna device in accordance with the first preferred embodiment.

The composed directivity 5B shown in FIG. 4 is a combination of the directivity 6B having weaker radiation in the main radiation direction X of the horn antenna 1*a* supplied with a power of a smaller amplitude and the directivity 7B having stronger radiation in the main radiation direction Y of the horn antenna 1*b* supplied with a power of a larger amplitude. Thus, changing the amplitudes of supplying powers allows the composed directivity 5B to be formed in a desired shape.

It is also possible that the horn antennas 1*a* and 1*b* are supplied with powers of different phases by making the power supply paths 3*a* and 3*b* differ in length. When the supplying powers differ both in phase and amplitude, radiation characteristics become wider in the vertical direction than in the horizontal direction.

Figure 5:
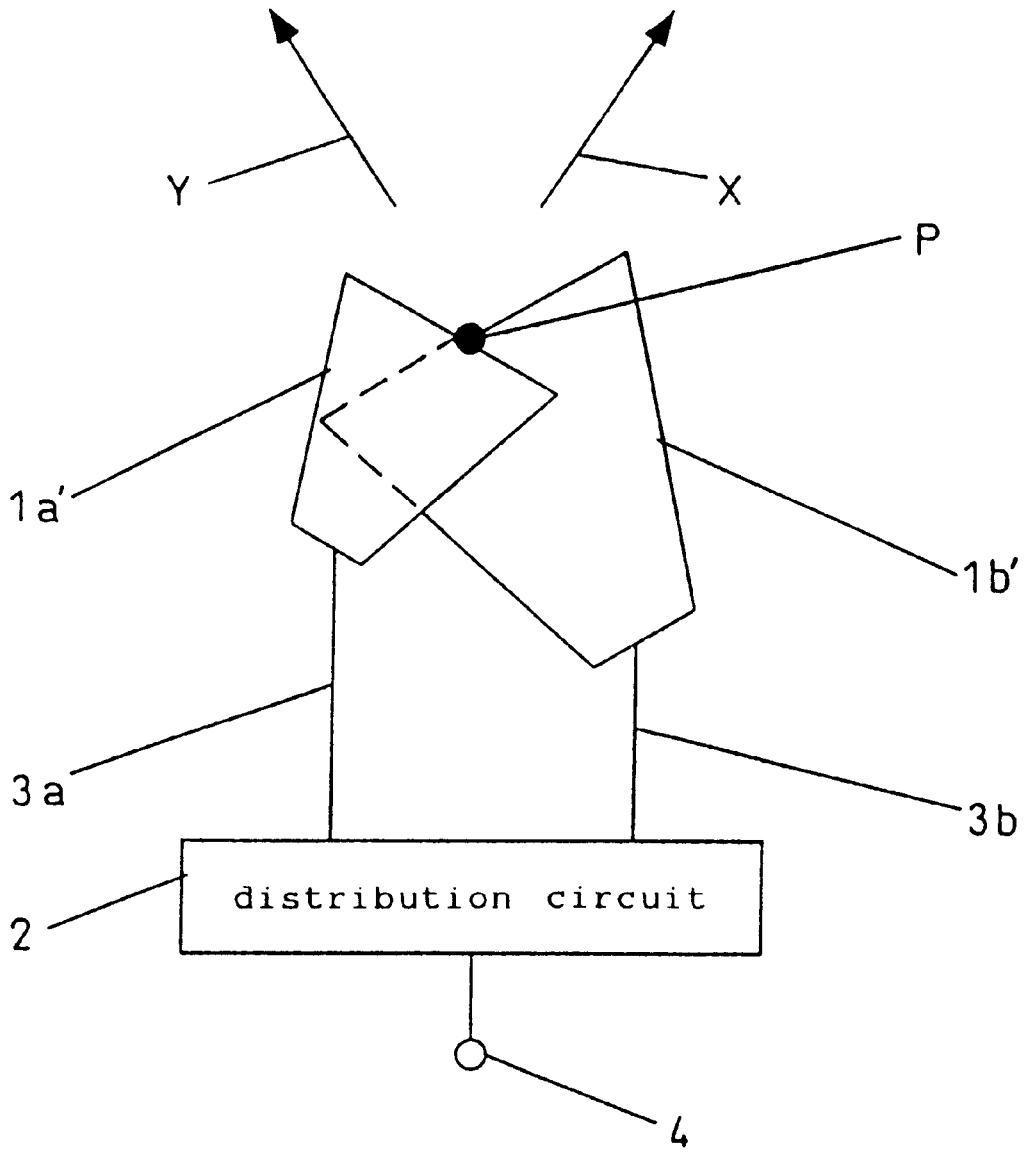
FIG. 5 is a plan view showing the structure of another modified antenna device in accordance with the first preferred embodiment.

It is possible to structure an antenna device by combining horn antennas 1*a*' and 1*b*' whose antenna openings are different in size as shown in FIG. 5, which has an effect of setting the directivity as desired. To be more specific, increasing the antenna opening in width sharpens the horizontal directivity, thereby narrowing the half-power beamwidth. On the other hand, decreasing the antenna opening in width makes the horizontal directivity dull, thereby widening the half-power beamwidth. This feature can be used to combine the horn antennas 1*a*' and 1*b*' having antenna openings different in size, so as to allow horizontal radiation characteristics to be formed in a desired shape.

(Second Preferred Embodiment)

While the antenna device of the first preferred embodiment uses the distribution circuit and power supply paths to connect the horn antennas and the radio, the antenna device of the present embodiment employs waveguides in place of the distribution circuit and power supply paths. The waveguides must be able to supply a power to each horn antenna with a minor power loss.

Figure 6:
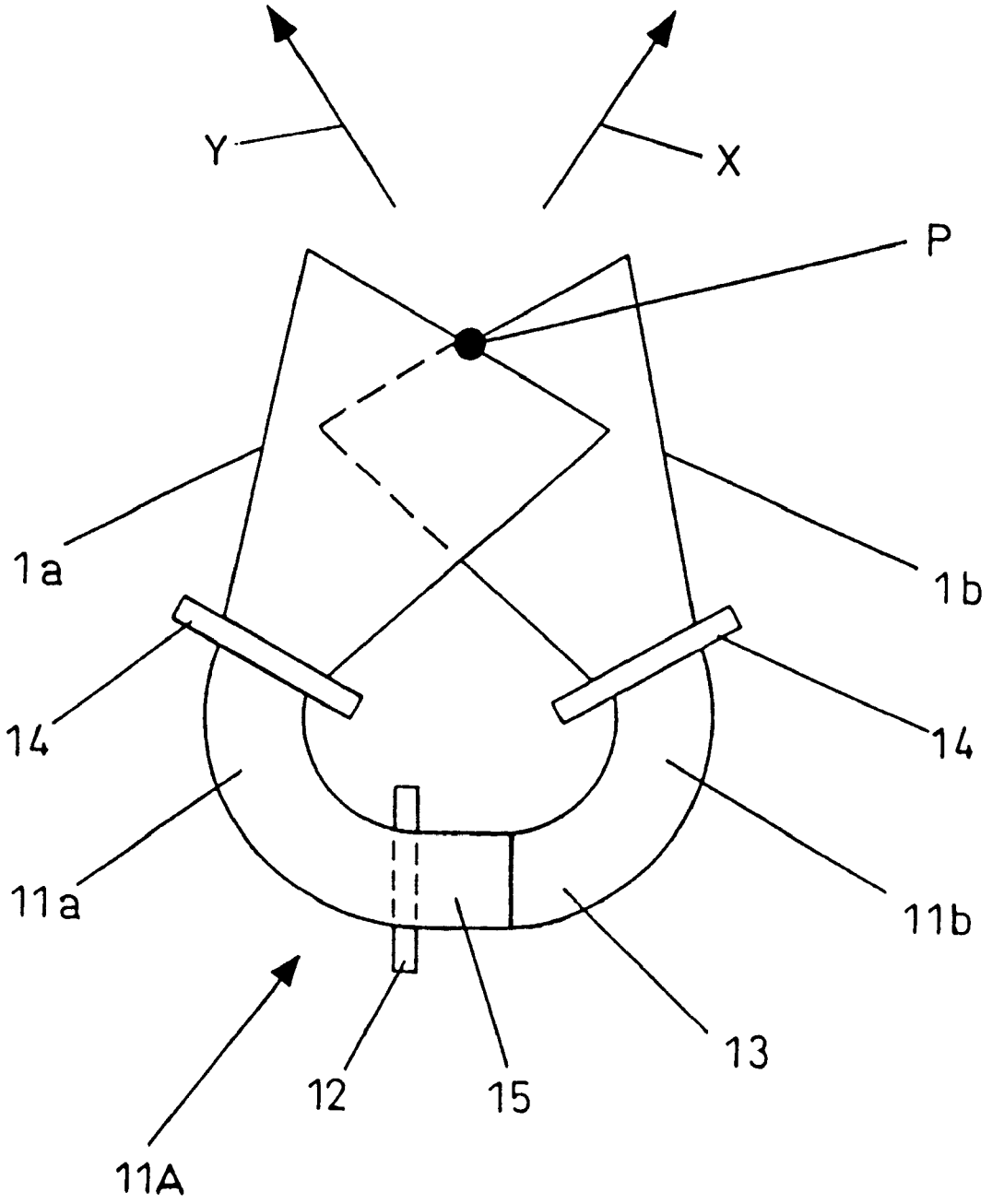
FIG. 6 is a plan view showing the structure of an antenna device in accordance with a second preferred embodiment.

As shown in FIG. 6, the antenna device of the present embodiment comprises a first horn antenna 1*a* and a second horn antenna 1*b* each having a directivity in the horizontal direction and a waveguide 11A which supplies an electric power to each of the antennas 1*a* and 1*b*. The arrangement relation between the horn antennas 1*a* and 1*b*, the single axis P, and the main radiation directions X and Y of the horn antennas 1*a* and 1*b*, respectively, is not described here because it is equal to that of the first preferred embodiment.

The waveguide 11A consists of a first and second waveguide paths 11*a* and 11*b*, which are connected to the horn antennas 1*a* and 1*b*, respectively, and further connected to a waveguide flange 12 via an E-plane T-branch waveguide 13. The waveguide flange 12 is an input/output terminal provided between the E-plane T-branch waveguide 13 and a radio (not shown).

Figure 7:
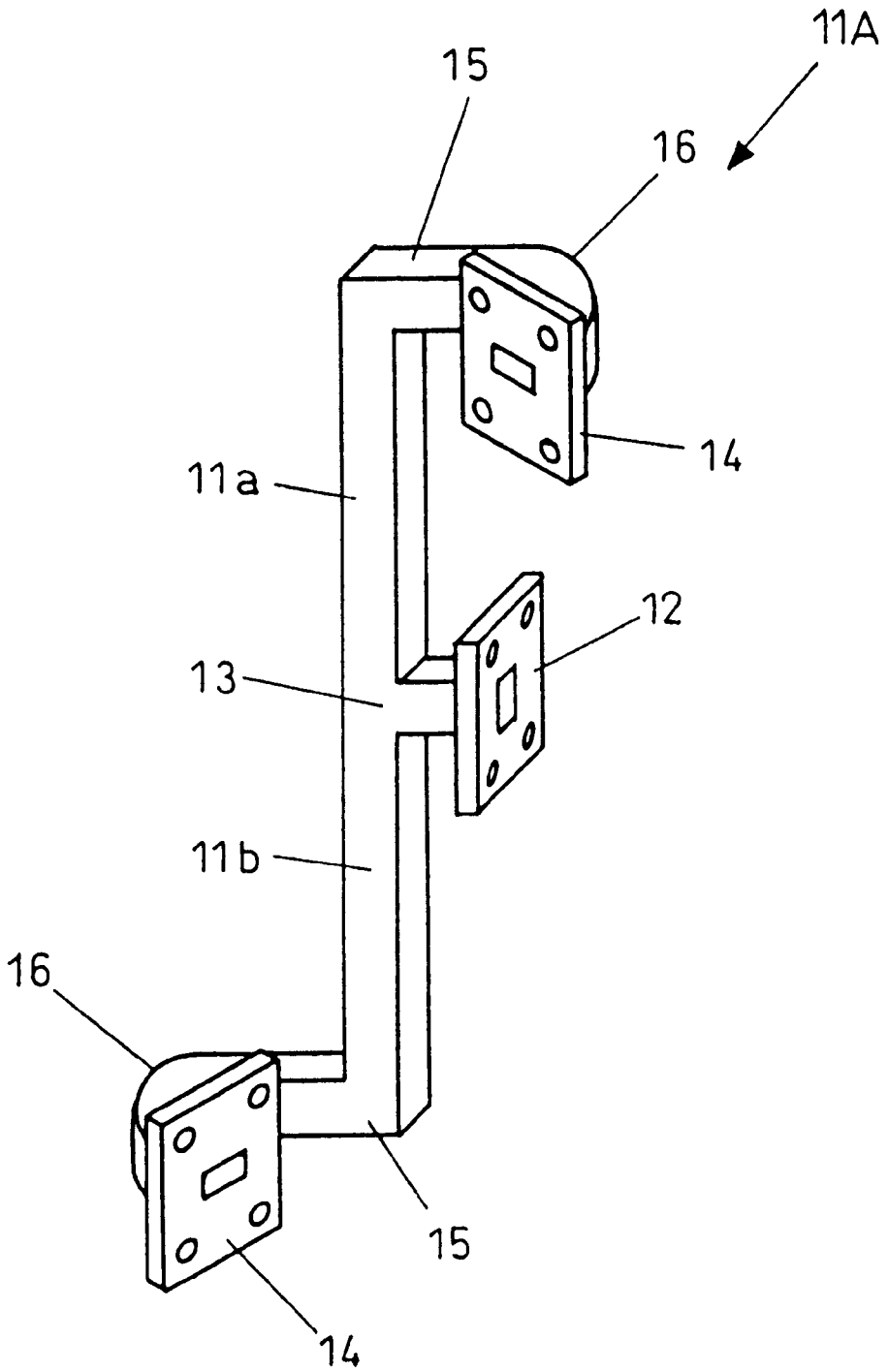
FIG. 7 is a perspective view showing the structure of the waveguide in the second preferred embodiment.

FIG. 7 illustrates waveguide flanges 14 connected to the horn antennas 1*a* and 1*b*, respectively, E-bend waveguides E 15, and H-bend waveguides 16 having respective curves corresponding to the curves of the horn antennas 1*a* and 1*b*.

In the present embodiment, the horn antennas 1*a* and 1*b* are supplied with powers of the same amplitude via the waveguide 11A, and the phases of the powers are adjusted by making the waveguide paths 11*a* and 11*b* differ in length. The lengths correspond to the lengths extending between the E-plane T-branch waveguide 13 and each of the waveguide flanges 14.

This structure allows the horn antennas 1*a* and 1*b* to be supplied with the powers of the same phase, and an antenna device having such horn antennas to form the same composed directivity 5A as shown in FIG. 3. Moreover, the powers to be supplied can be adjusted to have different phases from each other, and an antenna device having the adjusted power phases can obtain wider radiation characteristics in the vertical direction than in the horizontal direction.

Figure 8:
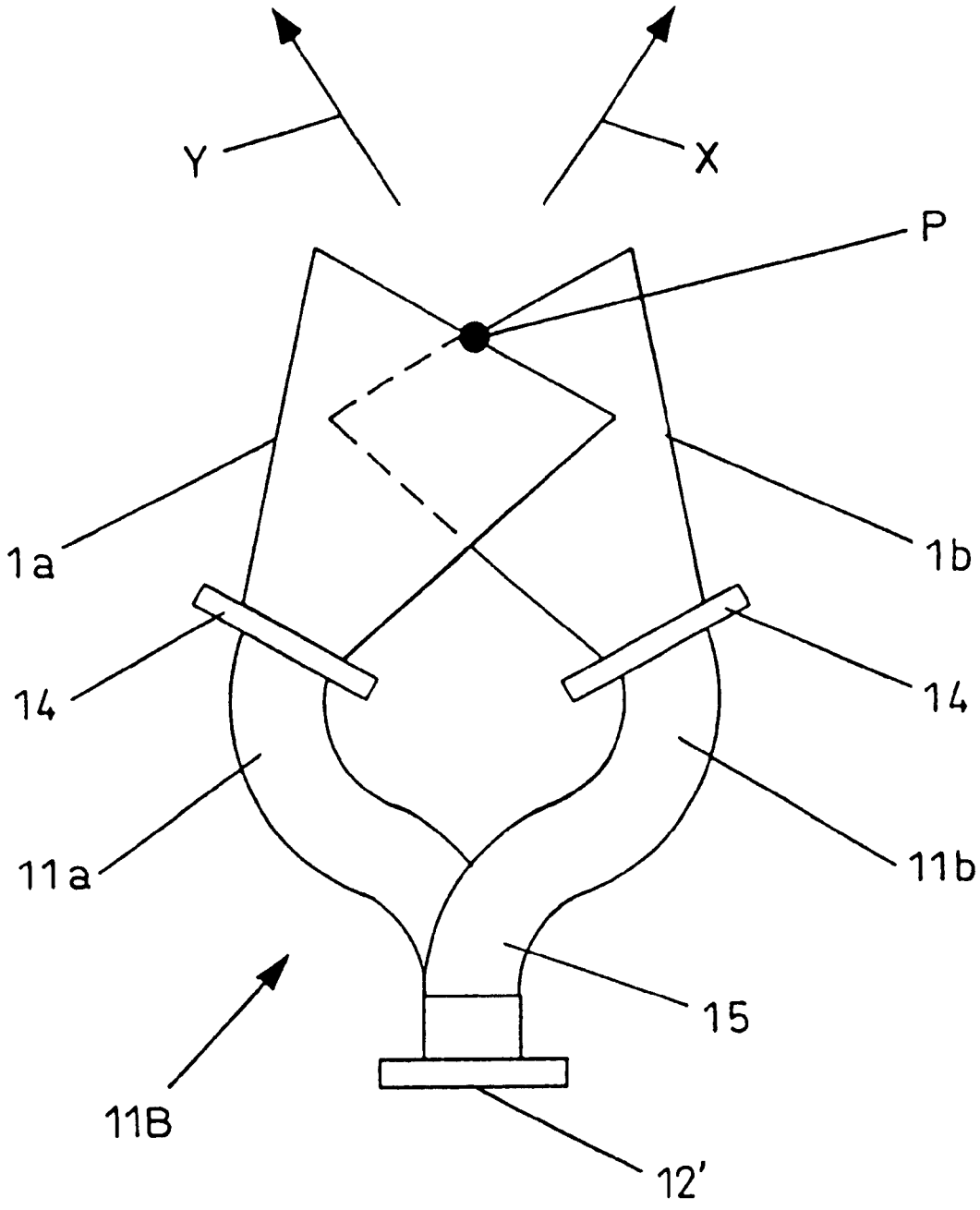
FIG. 8 is a plan view showing the structure of a modified antenna device in accordance with the second preferred embodiment.
Figure 9:
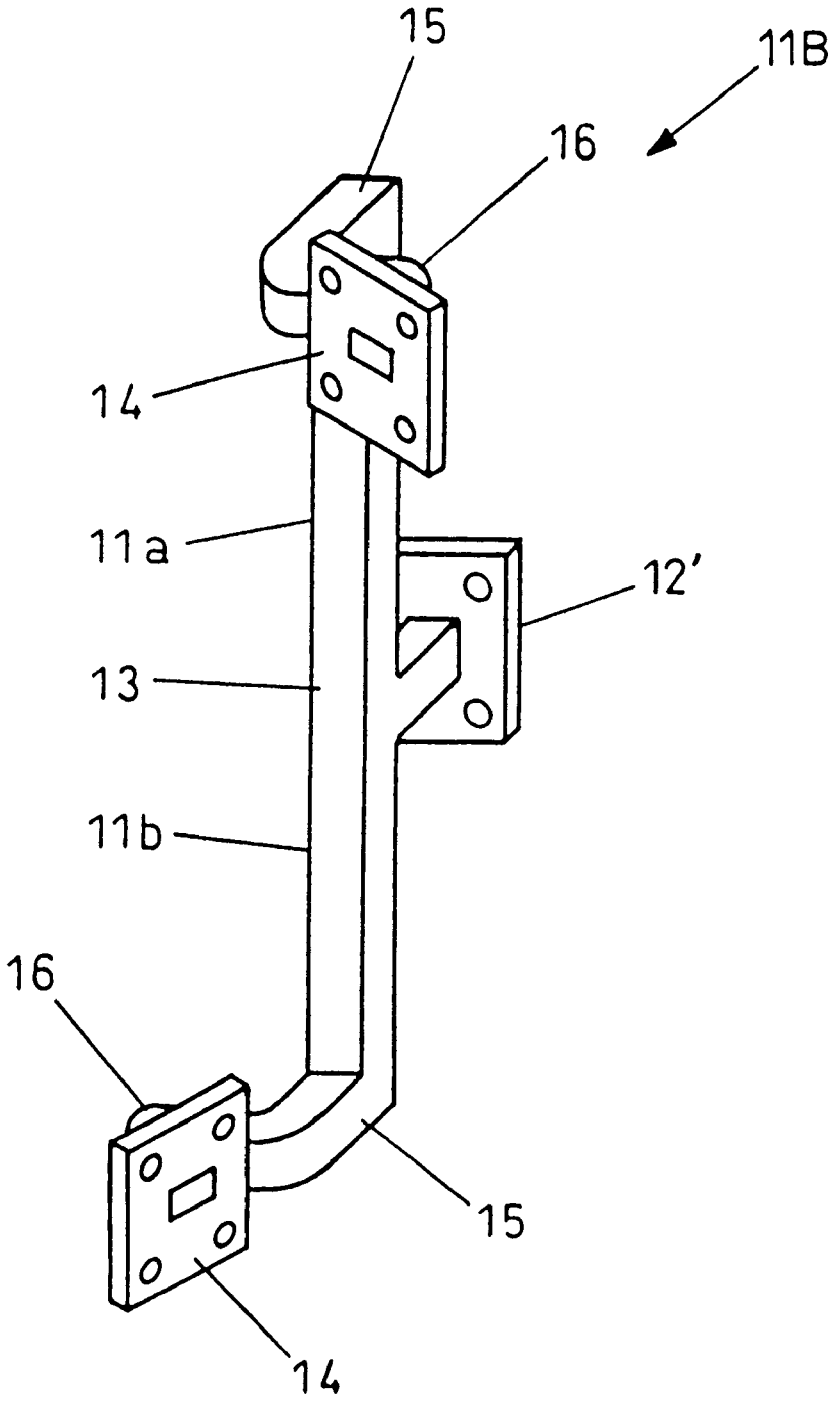
FIG. 9 is a perspective view showing the structure of a modified waveguide in the second preferred embodiment.

The structure of the antenna device of the present embodiment is not restricted to the one shown in FIGS. 6 and 7, and can be the one shown in FIGS. 8 and 9. The antenna device shown in FIGS. 8 and 9 is characterized by the structure of a waveguide 11B. To be more specific, a waveguide flange 12', which is a component of the waveguide 11B differs in structure from the one shown in FIGS. 6 and 7, and also slightly differs from the one shown in FIGS. 6 and 7 in the attached positions of the E-plane T-branch waveguide 13, E-bend waveguides 15, H-bend waveguides 16, and other components.

The waveguide flange 12 in the structure shown in FIGS. 6 and 7 is provided along the plane approximately parallel to the direction toward which the horn antennas 1*a* and 1*b* radiate radio waves. In contrast, the waveguide flange 12' in the structure shown in FIGS. 8 and 9 is provided along the plane approximately diagonal to the direction toward which the horn antennas 1*a* and 1*b* radiate radio waves. However, the antenna device shown in FIGS. 8 and 9 does not differ in basic structure from the one shown in FIGS. 6 and 7, so that like components in FIGS. 8 and 9 are labeled with like reference numerals with respect to FIGS. 6 and 7, and the description of these components is not repeated.

Figure 10:
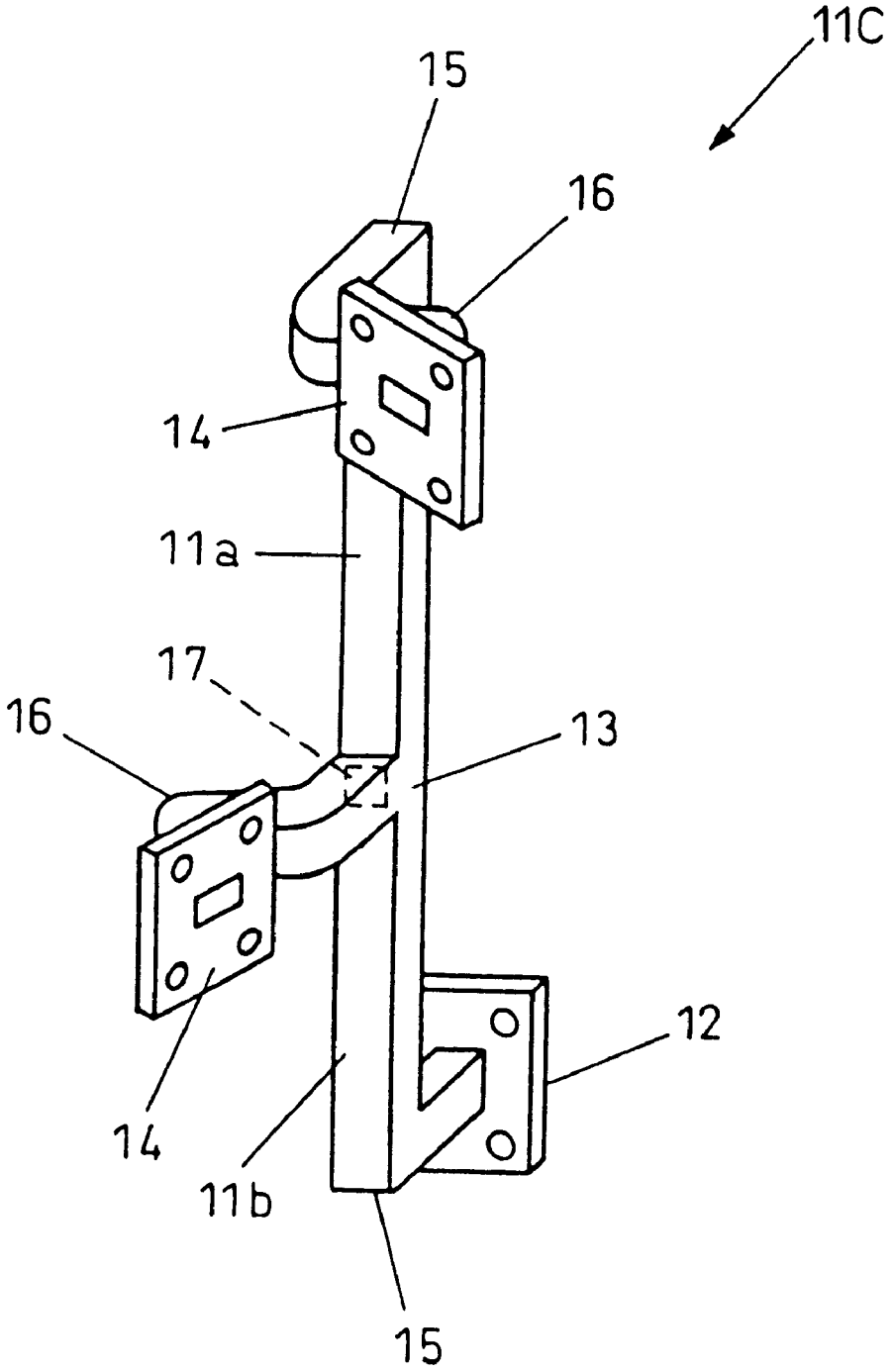
FIG. 10 is a perspective view showing the structure of another modified waveguide in the second preferred embodiment.

The waveguides 11A and 11B could be replaced by a waveguide 11C shown in FIG. 10. The waveguide 11C has a bond hole 17 for varying the amplitude of an electric power supplied, depending on the size of the antenna opening area. An antenna device provided with the waveguide 11C has the same effects as the one shown in FIGS. 6 and 7. To be more specific, with the waveguide 11C, the horn antennas 1*a* and 1*b* can be supplied with electric powers of the same phase and different amplitudes or with electric powers which differ both in phase and amplitude. Consequently, the directivity in the horizontal direction can be formed in a desired shape.

The two horn antennas used as directional antennas in the antenna devices of the first and second preferred embodiments could be replaced by patch antennas, or by three or more directional antennas.

(Third Preferred Embodiment)

Figure 11:
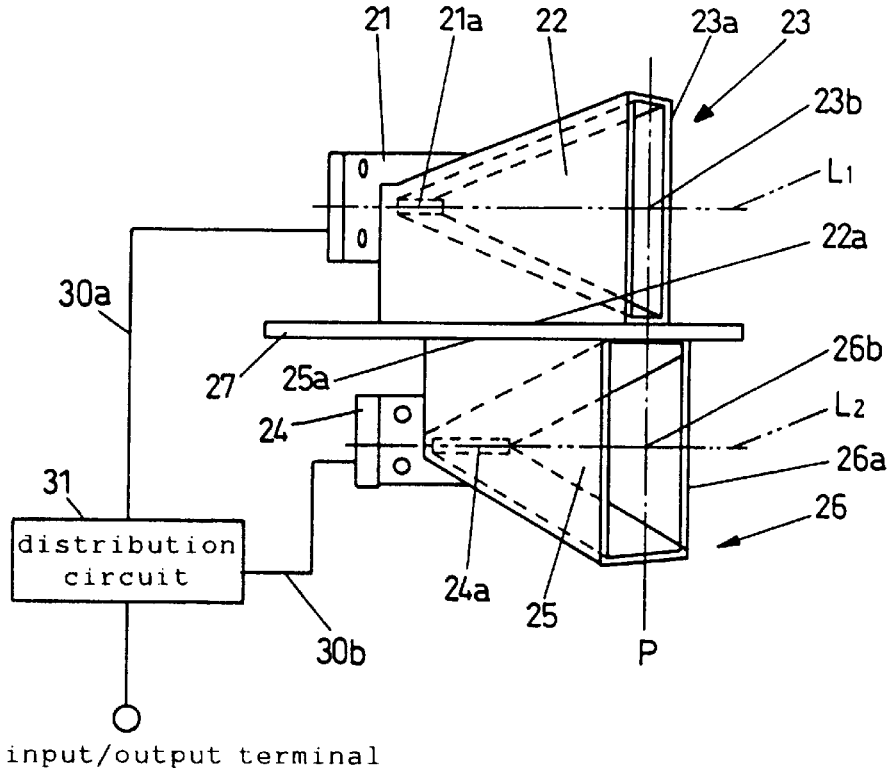
FIG. 11 is a side view showing the structure of an antenna device in accordance with a third preferred embodiment of the present invention.

The antenna device of the present embodiment comprises a first horn antenna 23 and a second horn antenna 26 as shown in FIG. 11. The horn antennas 23 and 26 are arranged in the vertical direction and connected to waveguides 21 and 24, respectively.

The horn antennas 23 and 26 are structured as follows. A cabinet 22 including the horn antenna 23 has a bottom surface 22*a* parallel to a line $L_1$ which links the center 21*a* of the opening portion of the waveguide 21 and the center 23*b* of the antenna opening 23*a* of the horn antenna 23. Similarly, a cabinet 25 including the horn antenna 26 has a top surface 25*a* parallel to a line $L_2$ which links the center 24*a* of the opening portion of the waveguide 24 and the center 26*b* of the antenna opening 26*a* of the horn antenna 26. These horn antennas 23 and 26 are arranged vertically in a manner as to position the antenna 23 above the antenna 26, and a fixing plate 27 is disposed between these antennas. Then, the bottom surface 22*a* and top surface 25*a* are touched with the front and back sides of the fixing plate 27 so as to fix the horn antennas 23 and 26 on the fixing plate 27. In the present embodiment, the bottom surface 22*a* and top surface 25*a* serve as bases to install the antennas 23 and 26 onto the fixing plate 27.

Hence, the main radiation directions X and Y in the horizontal planes of the horn antennas 23 and 26 are horizontal and parallel to each other. The waveguides 21 and 24 of the horn antennas 23 and 26, respectively, are connected to a distribution circuit 31 via power supply paths 30*a* and 30*b*, respectively. The symbol P in FIG. 11 indicates a single axis which coincides with the radiation centers of the horn antennas 23 and 26.

Figure 12:
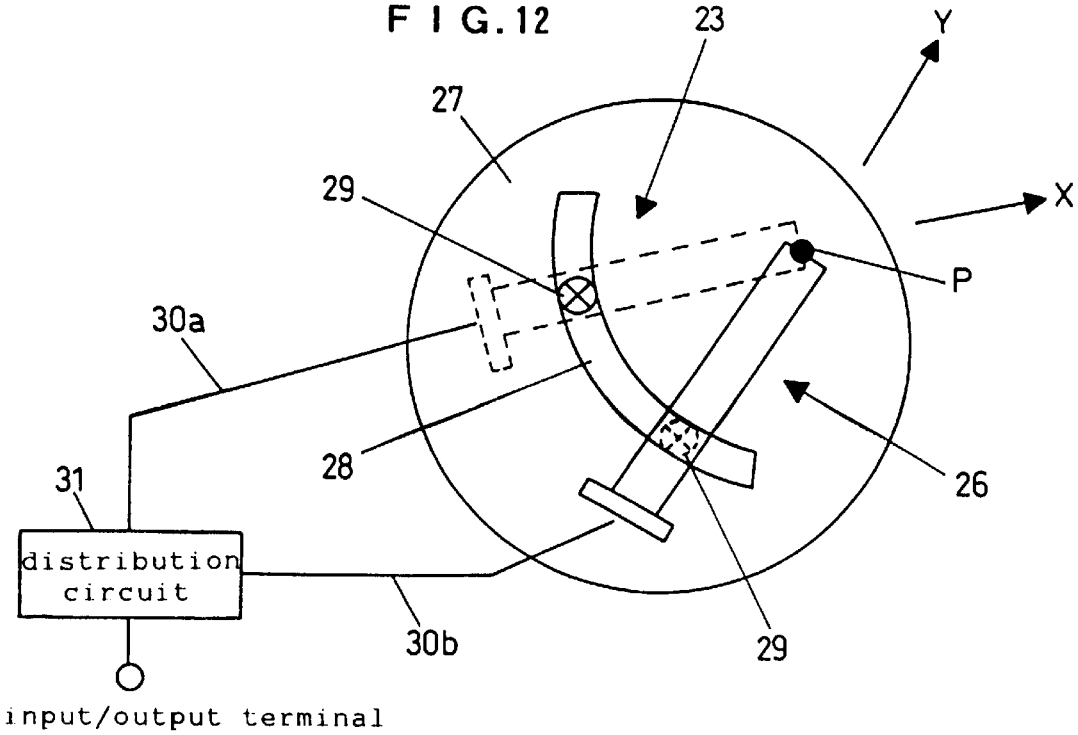
FIG. 12 is a plan view showing the structure of the antenna device in accordance with the third preferred embodiment.

Attachment of the horn antennas 23 and 26 to the fixing plate 27 will be described as follows with reference to FIG. 12. The fixing plate 27 is provided with a guide groove 28, which is included in an attachment angle setting unit. The guide groove 28 is arc-shaped, and the horn antennas 23 and 26 are fixed to the groove 28 by a screw 29. Loosing the screw 29 makes it possible to turn the horn antennas 23 and 26 as desired under the conditions that the same axis P, which is their radiation centers, is used as the turning axis. As a result, the radiation angle formed by the main radiation directions X and Y of the horn antenna 23 and 26, respectively, can be set arbitrary while the axis P, which is the center of radiation, is fixed.

The specific attachment of the horn antennas 23 and 26 to the guide groove 28 may be conducted as follows. The screw 29 is composed of a male and female threads, and the male thread is so attached as to prevent the horn antennas 23 and 26 from turning. In addition, a square prism portion is formed at some midpoint in the longitudinal direction of the male thread so as to have the approximate same size as the width of the guide groove 28. On the other hand, the curvature of the arc-shaped guide groove 28 is set so that the center of the arc coincides with the axis P, which is the centers of the radiations of the horn antennas 23 and 26. Then, the square prism portion is inserted to the guide groove 28, and the horn antennas 23 and 26 are arranged in the direction of the diameter of the arc formed by the guide groove 28. Under these conditions, the female thread is screwed against the tip of the male thread. Thus, the horn antennas 23 and 26 sandwich the fixing plate 27 so as to be fixed to the fixing plate 27 by the female thread. Since the square prism portion is in contact with the guide groove 28, the male thread does not turn, which further prevents the horn antennas 23 and 26 from turning. This structure allows the radiation angle formed by the main radiation directions X and Y of the antennas 23 and 26 to be set freely within the range between both ends of the guide groove 28 under the conditions that the axis P as the centers of the radiations is firmly fixed.

The fixing plate 27 is preferably made of an insulating material of an organic system such as acrylic or polypropylene, or an inorganic system in order to obtain better radiation characteristics.

Figure 13:
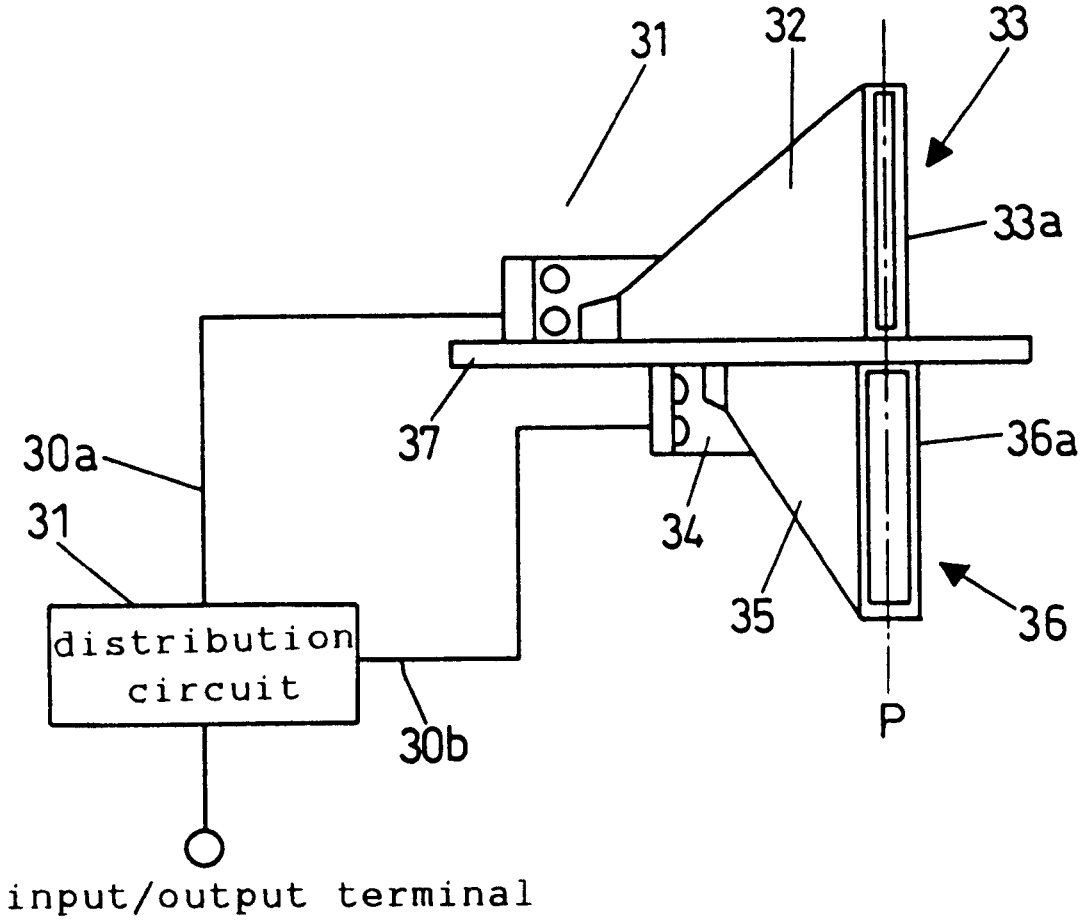
FIG. 13 is a side view showing the structure of a modified antenna device in accordance with the third preferred embodiment.

FIG. 13 shows another example of attaching horn antennas. The horn antennas 33 and 36 in this example consist of a pair of antennas formed by dividing one horn antenna vertically along the line linking the center of the opening portion of a waveguide and the center of the antenna opening of the horn antenna. The horn antennas 33 and 36 are connected to a first and second waveguides 31 and 34, respectively. The bottom surface of the horn antenna 33 and the top surface of the horn antenna 36 sandwich the fixing plate 37. Since these antennas 33 and 36 are installed to the fixing plate 37 in the same manner as in FIGS. 11 and 12, a detailed description will be omitted.

In this modified example, the radiation directions of the horn antennas 33 and 36 slightly expand in the vertical direction, failing to be parallel; however, the radiation angle formed by the main radiation directions of the antennas 33 and 36 can be set arbitrary under the conditions that the axis P as the radiation centers is fixed.

Figure 14:
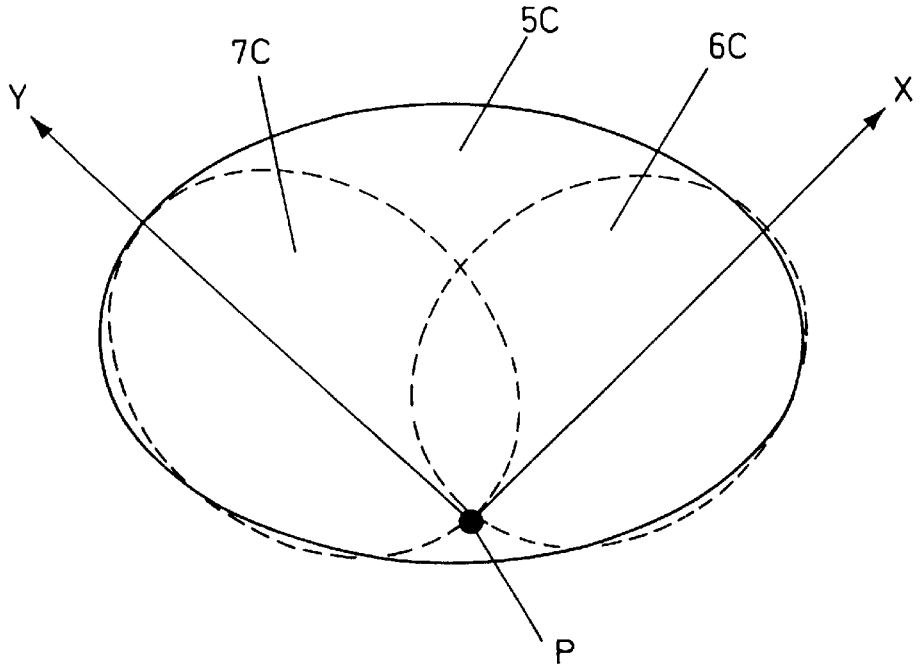
FIG. 14 shows the horizontal directivity of the antenna device in accordance with the third preferred embodiment.

FIG. 14 shows the directional characteristics formed by the antenna device of the present embodiment. The horn antenna 23 (33) has the main radiation direction X and the directivity 6C, and the horn antenna 26 (36) has the main radiation direction Y and the directivity 7C. The horn antennas 23 (33) and 26 (36) are arranged so as to make the main radiation directions X and Y apart from each other laterally at an angle of θ. With this arrangement of the antennas 23 (33) and 26 (36), the directivity 5C having a large half-power beamwidth can be obtained by composing the directivities 6C and 7C.

Figure 15:
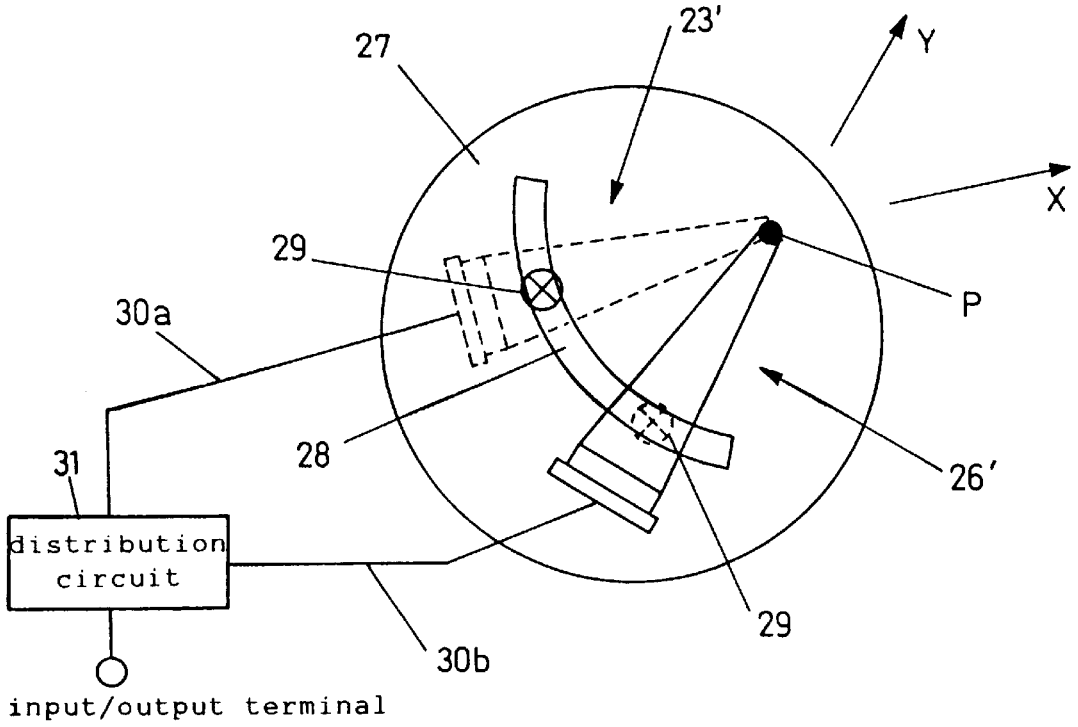
FIG. 15 is a plan view showing the structure of another modified antenna device in accordance with the third preferred embodiment.

In the present embodiment, the opening portions of the power supply part waveguides 21 (31) and 24 (34) have the same width as the antenna openings 23*a* (33*a*) and 26*a* (36*a*). Alternatively, at least one of the antenna openings 23*a* (33*a*) and 26*a* (36*a*) can be made shorter in width than the opening portions of the power supply part waveguides 21 (31) and 24 (34) so as to have a larger half-power beamwidth of the horizontal plane. FIG. 15 shows an example where the antenna openings 23*a* and 26*a* of the antennas 23' and 26' are shorter in width than the opening portions of the power supply part waveguides 21 and 24.

As described hereinbefore, the present embodiment offers an antenna device provided with horn antennas whose radiation characteristics have an efficiently expanded half-power beamwidth.

(Fourth Preferred Embodiment)

Figure 16:
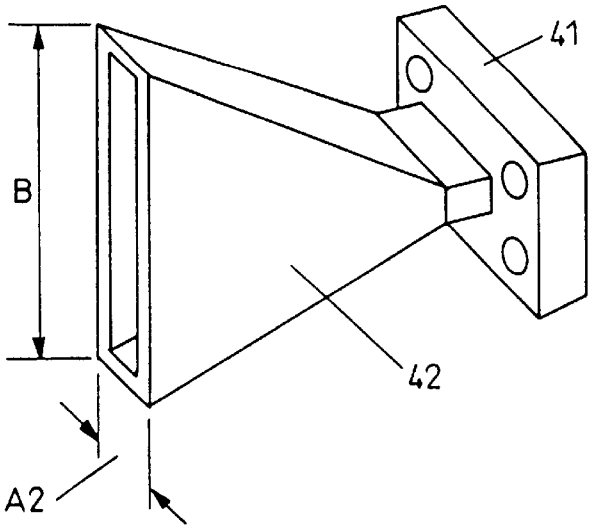
FIG. 16 is a perspective view showing the structure of an antenna device in accordance with a fourth preferred embodiment.

As shown in FIGS. 16 and 17, the antenna device of the present embodiment comprises a horn antenna 42 connected to an end of a waveguide 41, and is characterized by the structure of the horn antenna 42.

Figure 19:
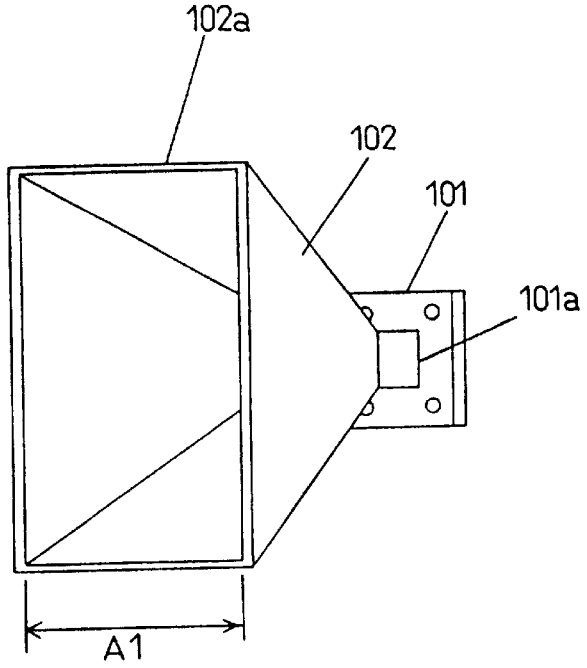
FIG. 19 is a perspective view showing the structure of a prior art antenna device.

As shown in FIG. 19 a prior art horn antenna 102 has the geometry of a pyramid in which the width A1 of an antenna opening 102*a* is larger than the width of the opening portion 101*a* of a waveguide 101.

Figure 17A:
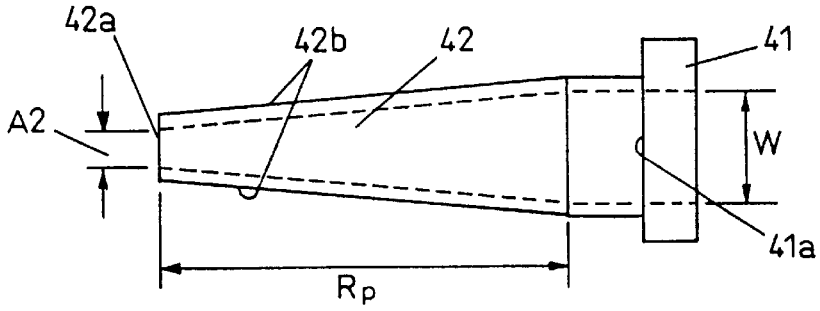
FIG. 17A is a plan view showing the structure of the antenna device in accordance with the fourth preferred embodiment.

In contrast, in the present embodiment, as shown in FIG. 17A, the width A2 of an antenna opening 42*a* of the horn antenna 42 is smaller than the width w of the opening portion 41*a* of the waveguide 41. To be more specific, the left and right side surfaces 42*b* of the cabinet including the horn antenna 42 is tapered from the opening portion 41*a* of the waveguide 41 to the antenna opening 42*a* so as to make the width A2 of the antenna opening 42*a* smaller than the width w of the opening portion 41*a* of the waveguide 41.

Figure 17B:
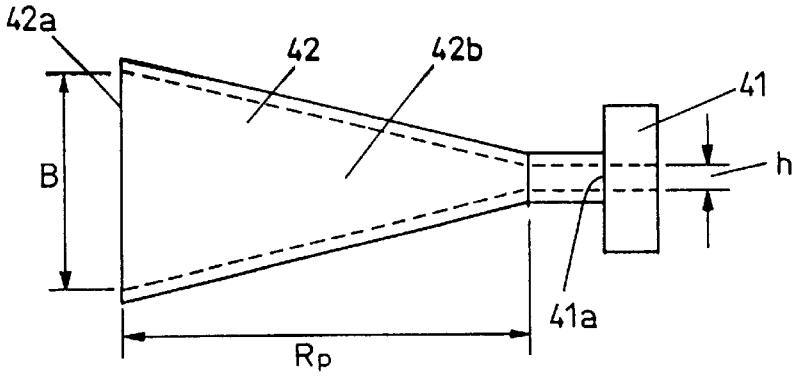
FIG. 17B is a side view showing the structure of the antenna device in accordance with the fourth preferred embodiment.

As shown in FIG. 17B, the height B of the antenna opening 42*a* is made larger than the height h of the opening portion 41*a* of the waveguide 41 and can be determined as indicated in the formula below to offer a gain suitable for a required system. To the be more specific, when the horn antenna 42 has a length of $R_p$, the optimum gain can be obtained by setting the height B as found in the following formula:

$B \approx (2R_p\lambda)^{1/2}$ ($\lambda$: spatial wavelength of usable frequency)

According to the present embodiment, the half-power beamwidth of the horizontal plane is made larger by making the width A2 of the antenna opening 42*a* smaller than the width w of the opening portion 41*a* of the waveguide 41 so as to taper the side surfaces.

The following is a description of the measurement results on the effects of increasing the half-power beamwidth of the antenna device. A half-power beamwidth θ (deg) and a gain (dBi) were measured while the width A2 of the antenna opening 42*a* is changed under the conditions that the opening portion 41*a* of the waveguide 41 has a width w of 8.6 mm and a height h of 4.3 mm, and the antenna opening 42*a* has a height B of 50 mm and a length of 100 mm. The measurement results are shown in FIG. 18, where the horizontal axis indicates the width A2 of the opening 42*a* and the vertical axis indicates the half-power beamwidth θ (deg) and the gain (dBi).

Figure 18:
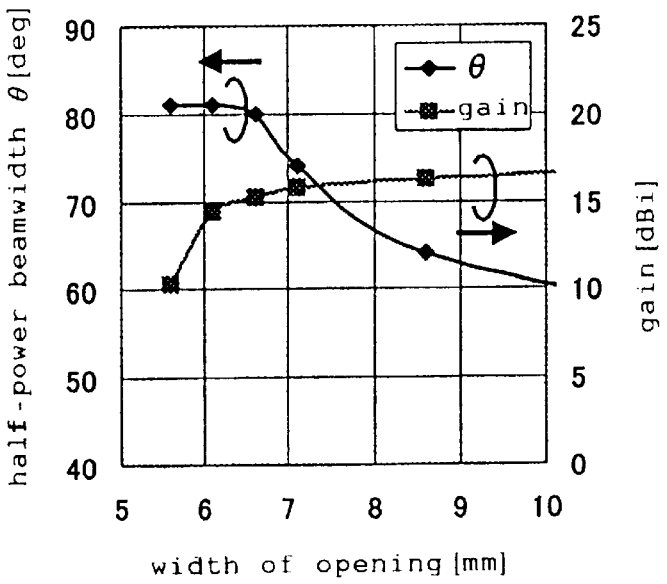
FIG. 18 is a graph showing the measurement results of the half-power beamwidth of the antenna device in accordance with the fourth preferred embodiment.

As apparent from FIG. 18, when the width A2 of the antenna opening 42*a* is equal to the width w (8.6 mm) of the opening portion 42*a*, the half-power beamwidth θ is only about 64 degrees; however, when the width w of the antenna opening 42*a* is reduced down to around 6.6 mm, the half-power beamwidth θ can be expanded as large as 80 degrees or so. The width w of the antenna opening 42*a* being smaller than 6.6 mm could not make the half-power beamwidth θ larger than 80 degrees, and on the contrary, the gain would be rapidly reduced. This is considered to result from the influence of the cutoff frequency of the waveguide 41. The measurement results indicate that when the ratio of the width A2 of the antenna opening 42*a* to the width w of the waveguide 41 (A2/w) is set at about 6.6/8.6, a large half-power beamwidth can be obtained while preventing the gain from decreasing due to the cutoff frequency of the waveguide 41.

Alternatively, the width of the antenna opening 42*a* can be reduced as follows. A shielding wall for shielding the antenna opening 42*a* is provided at the left and right ends of the antenna opening 42*a*, and a radio wave absorber is applied onto the wall to reduce the width of the antenna opening 42*a*. However, that case has a drawback that a loss caused by the radio wave absorber decreases the gain, and growing internal volume of the antenna prevents the miniaturization of the antenna device. In contrast, the present embodiment does not need a radio wave absorber, which reduces the gain drop. Moreover, the internal volume of the antenna does not grow, and, on the contrary, can be reduced, which facilitates the miniaturization of the antenna device.

The above-mentioned embodiments can provide horn antennas with excellent radiation characteristics having a large half-power beamwidth, thereby largely contributing to the establishment of information communication network provided with an inexpensive and high information density mainly for general household telephones. In addition, the occurrence of a drop in directivity due to the array factor can be effectively prevented. Hence, wide radiation characteristics in the horizontal plane can be secured easily, regardless of the simple structure.

The preferred embodiments of the present invention are described hereinbefore in detail. Combination and arrangement of the components contained in these embodiments can be changed variously without departing from the spirit or scope of the present invention claimed below.

What is claimed is:

1. An antenna device comprising a plurality of directional antennas which are aligned on a same axis in one direction and which are also arranged in a manner that main radiation directions of said plurality of directional antennas deviate from each other in a direction orthogonal to said one direction.

2. The antenna device according to claim 1, wherein said one direction is a vertical direction.

3. The antenna device according to claim 1 further comprising a distribution circuit for supplying said plurality of directional antennas with electric powers.

4. The antenna device according to claim 3, wherein said distribution circuit supplies said plurality of directional antennas with electric powers of a same amplitude and phase.

5. The antenna device according to claim 3, wherein said distribution circuit supplies said plurality of directional antennas with electric powers of a same amplitude and different phases.

6. The antenna device according to claim 3, wherein said distribution circuit supplies said plurality of directional antennas with electric powers of a same phase and different amplitudes.

7. The antenna device according to claim 3, wherein said distribution circuit supplies said plurality of directional antennas with electric powers of different amplitudes and different phases.

8. The antenna device according to claim 1 further comprising a power supply part waveguide, and said plurality of directional antennas are horn antennas connected to said power supply part waveguide.

9. The antenna device according to claim 8, wherein at least one of said plurality of directional antennas has an antenna opening shorter in width than an opening portion of said power supply part waveguide.

10. The antenna device according to claim 8 further comprising a fixing plate which is arranged in a direction orthogonal to said one direction, wherein said plurality of directional antennas are provided with respective placing surfaces which are arranged parallel to the direction orthogonal to said one direction, and which are in contact with a front and back sides of said fixing plate so as to fix the antenna device thereonto.

11. The antenna device according to claim 10 further comprising an installment angle setting unit for freely adjusting the main radiation directions of said plurality of directional antennas fixed on the fixing plate.

12. An antenna device comprising a horn antenna connected to a power supply part waveguide, wherein a width dimension of an antenna opening of said horn antenna is shorter than a corresponding width dimension of an opening portion of said power supply part waveguide.

13. The antenna device according to claim 12, wherein side surfaces of said horn antenna are tapered from the opening portion of said power supply part waveguide to the antenna opening, so as to make the antenna opening of said horn antenna shorter in width than the opening portion of said power supply part waveguide.

14. The antenna device according to claim 1, wherein an outer-most portion of each of said plurality of directional antennas forms a plane having a center axis, said center axis of each of said plurality of directional antennas being aligned on said same axis.

15. The antenna device according to claim 14, wherein each of said plurality of directional antennas has a main radiation axis, said main radiation axis of each of said plurality of directional antennas intersecting at said same axis.

* * * * *